US010253391B2

(12) United States Patent
Diekmann

(10) Patent No.: US 10,253,391 B2
(45) Date of Patent: Apr. 9, 2019

(54) COMPONENTS MADE OF A STEEL ALLOY AND METHOD FOR PRODUCING HIGH-STRENGTH COMPONENTS

(71) Applicants: MATPLUS GMBH, Wuppertal (DE); COMTES FHT A.S., Dobrny (CZ)

(72) Inventor: Uwe Diekmann, Wuppertal (DE)

(73) Assignees: MATPLUS GMBH, Wuppertal (DE); COMTES FHT A.S., Dobrany (CZ)

( * ) Notice: Subject to any disclaimer, the term of this patent is extended or adjusted under 35 U.S.C. 154(b) by 82 days.

(21) Appl. No.: 15/127,540

(22) PCT Filed: Mar. 24, 2015

(86) PCT No.: PCT/EP2015/056187
§ 371 (c)(1),
(2) Date: Sep. 20, 2016

(87) PCT Pub. No.: WO2015/144661
PCT Pub. Date: Oct. 1, 2015

(65) Prior Publication Data

US 2017/0114426 A1 Apr. 27, 2017

(30) Foreign Application Priority Data

Mar. 24, 2014 (DE) ..... 10 2014 205 392

(51) Int. Cl.
*C22C 38/16* (2006.01)
*C22C 38/54* (2006.01)
(Continued)

(52) U.S. Cl.
CPC ..... *C21D 9/525* (2013.01); *C21D 1/26* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS

2007/0051433 A1* 3/2007 Kamo ..... C22C 38/02 148/332
2014/0170440 A1* 6/2014 Kawata ..... C23C 2/02 428/659
2015/0059912 A1* 3/2015 Shimamura ..... B23K 9/23 138/177

FOREIGN PATENT DOCUMENTS

JP H02197547 8/1990
JP 3954153 8/2007

OTHER PUBLICATIONS

English translation of PCT International Preliminary Report on Patentability and Written Opinion of the International Searching Authority for International Application No. PCT/EP2015/056187, dated Sep. 27, 2016, 12 pages.
(Continued)

*Primary Examiner* — George Wyszomierski
(74) *Attorney, Agent, or Firm* — Barnes & Thornburg LLP

(57) ABSTRACT

The invention concerns a component made of a steel alloy comprising iron and as alloying element copper, in particular consisting of (in wt % in relation to the total alloy, wherein the sum of all constituents equals 100 wt %) iron≥96, carbon 0.04 to 0.12, copper 0.5 to 2.0, manganese+silicon+chromium+nickel 0.5 to 2.5, titanium 0 to 0.1, boron 0 to 0.005, and typical unavoidable impurities. In the production of semi-finished goods and of components, a combination of cold working and annealing treatment below the recrystallization temperature is used in order to thus obtain advantageous properties with regard to strength and ductility.

15 Claims, 5 Drawing Sheets

(51) Int. Cl.

| | |
|---|---|
| ***C21D 9/52*** | (2006.01) |
| ***C21D 6/02*** | (2006.01) |
| ***C21D 7/02*** | (2006.01) |
| ***C21D 8/02*** | (2006.01) |
| ***C21D 8/04*** | (2006.01) |
| ***C21D 8/06*** | (2006.01) |
| ***C21D 8/10*** | (2006.01) |
| ***C21D 9/08*** | (2006.01) |
| ***C21D 9/46*** | (2006.01) |
| ***C21D 9/48*** | (2006.01) |
| ***C21D 1/26*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/18*** | (2006.01) |
| ***C21D 6/00*** | (2006.01) |
| ***C22C 38/42*** | (2006.01) |
| ***C22C 38/50*** | (2006.01) |

(52) U.S. Cl.

CPC ..... *C21D 6/02* (2013.01); *C21D 7/02* (2013.01); *C21D 8/02* (2013.01); *C21D 8/0205* (2013.01); *C21D 8/0236* (2013.01); *C21D 8/0247* (2013.01); *C21D 8/04* (2013.01); *C21D 8/0405* (2013.01); *C21D 8/0436* (2013.01); *C21D 8/0447* (2013.01); *C21D 8/06* (2013.01); *C21D 8/065* (2013.01); *C21D 8/10* (2013.01); *C21D 8/105* (2013.01); *C21D 9/08* (2013.01); *C21D 9/46* (2013.01); *C21D 9/48* (2013.01); *C21D 9/52* (2013.01); *C22C 38/02* (2013.01); *C22C 38/04* (2013.01); *C22C 38/08* (2013.01); *C22C 38/12* (2013.01); *C22C 38/16* (2013.01); *C22C 38/18* (2013.01); *C22C 38/42* (2013.01); *C22C 38/50* (2013.01); *C22C 38/54* (2013.01); *C21D 2211/004* (2013.01)

(56) References Cited

OTHER PUBLICATIONS

PCT International Search Report of International Application No. PCT/EP2015/056187, dated Sep. 25, 2015, 14 pages.

Sanjay Panwar et al.; Aging of a Copper Bearing HSLA-100 Steel; Bulletin of Materials Science; Bd. 26, Nr. 4; Jun. 1, 2003; 8 pages.

Mikalac S J et al.; Strength and Toughness Response to Aging in a High Copper HSLA-100 Steel; Proceedings of the International Conference on Processing, Microstructure and Properties of Microalloyed and Other Modern Hight Strength Low Alloy Steels; Jun. 3-6, 1991; Pittsburgh, PA; Iron and Steel Society, US; 14 pages.

* cited by examiner

COMPONENTS MADE OF A STEEL ALLOY AND METHOD FOR PRODUCING HIGH-STRENGTH COMPONENTS

CROSS-REFERENCE TO RELATED APPLICATIONS

This application is a national stage entry under 35 USC § 371(b) of PCT International Application No. PCT/EP2015/056187, filed 24 Mar. 2015, and claims the benefit of German Patent Application No. 102014205392.7, filed 24 Mar. 2014, both of which are expressly incorporated by reference herein.

The invention concerns a component made of a steel alloy as well as a method for its production. A component within the meaning of the present invention can be a semi-finished good.

STATE OF THE ART AND TECHNICAL BACKGROUND

Light weight construction with high strength steels enables costs and recourses efficient products. The strength of steels can be increased though solid solution hardening, conversion hardening, fine grained hardening, precipitation hardening and cold forming. Usually, all these mechanism provide a contribution to the component strength.

Known is the so-called "steel-banana", which illustrates the relationship of strength and elongation at break for different steel grades. This is shown in FIG. 1 (Source: ADVANCED HIGH STRENGTH STEEL (AHSS) APPLICATION GUIDELINES Version 4.1, www-.worldautosteel.org).

In the documents "A. J. DeArdo and R. A. Walsh, "High strength low alloy steel", U.S. Pat. No. 5,352,304 A04-Okt-1994" and "E. J. Czyryca, "Development of law-carbon, copper-strengthened HSLA steel plate for naval ship construction", DTIC Document, 1990", high strength Cu alloyed steels are described, which are preferably used in ship construction in a hot rolled and hardened condition. The steel is additionally alloyed with nickel in order to reduce the susceptibility to red shortness and to increase the ductility. Such high nickel contents are however not applicable in many markets and applications for financial reasons.

The possibility of the use of Cu for the increase in strength of IF-steel is described in the document "R. Rana, W. Bleck, S. B. Singh, and O. N. Mohanty, "Development of high strength interstitial free steel by copper precipitation hardening", Mater. Lett., ed. 61, No 14, p. 2919-2922, 2007". By addition of copper, high strengths of 500-600 MPa are reached. The document "R. Rana, S. B. Singh, and O. N. Mohanty, "Effect of composition and pre-deformation on age hardening response in a copper-containing interstitial free steel", Mater. Charact., ed. 59, no 7, p. 969-974, July 2008" concerns investigations about the influence of the deformation on the precipitation and strengthening behavior of a Cu alloyed IF-steel. According to that, the precipitation hardening is accelerated though a deformation of more than 40%. The document "N. Maruyama, M. Sugiyama, T. Hara, and H. Tamehiro, "Precipitation and phase transformation of copper particles in low alloy ferritic and martensitic steels", Mater. Trans.-JIM, ed. 40, p. 268-277, 1999" discloses that the strength of a Cu alloyed ferritic, cold work hardened material increases having an annealing treatment between 700 and 900 kelvin. The influence of copper addition is described in the document "R. Rana. W. Bleck, S. B. Singh, and O. N. Mohanty, "Hot shortness behavior of a copper-alloyed high strength interstitial tree steel", Mater. Sci. Eng. A, ed. 588, p. 288-298, Dez. 2013".

The document "D. isheim, M. S. Gagliana, M. E. Fine, and D. N. Seidman, "Interfacial segregation at Cu-rich precipitates in a high-strength low-carbon steel studied on a sub-nanometer scale", Acta Mater., ed. 54, no 3, p. 841-849, February 2006" describes the use of a atom probe (APT Atom Probe Tomography) for the analysis of the Cu precipitation of a high strength steel for ship building applications. Cu precipitations in steel are not detectable with conventional light microscopic and scanning electron microscopic methods, because the size of the precipitated particles lies in the area of a few nanometers.

A tensile test for metallic materials is a to DIN EN ISO 6892 standardized material testing standard method. According to the invention, the material parameters are preferably also measured according to this DIN.

An elongation at break A is a material parameter, which shows the remaining elongation of a sample after the break in relation to the initial measuring length. It characterizes the ductility (deformation capability) of a material. It is the remaining length difference ΔL after occurred breakage in relation to the initial measuring length $L_0$ of a sample in the tensile test.

$$A=\Delta L/L_0\cdot 100\%$$

The initial length $L_0$ is defined by means of measuring marks on the tensile specimen prior to the tensile test. Due to the locally limited necking, the elongation at break A is depending from the initial measuring length $L_0$. In order to obtain comparable values for the elongation at break, most of the time proportional sticks are used for the tensile tests, i.e. specimen having the initial measuring length $L_0$ being in a fixed relation to the initial cross section $S_0$.

$$L_0=k\cdot d_0$$

For round rods, a value of K=5 is common. The elongation at beak is then called A5.

During tensile testing, a local necking occurs with ductile materials after reaching the tensile strength $R_m$, wherein in this area then also occurs the break. The thereby biggest occurring relative change in cross section is called necking (reduction in area at break or failure) Z. This is a measure for ductility of the material:

$$\begin{aligned} Z &= \frac{\Delta S}{S_0}\cdot 100\% \\ &= \frac{S_0 - S_u}{S_0}\cdot 100\% \\ &= \left(1-\frac{S_u}{S_0}\right)\cdot 100\% \end{aligned}$$

with the initial cross section area $S_0$ of the unloaded specimen rod and the smallest cross section area $S_u$ of the broken rod, thus the remaining cross section area at the place of necking.

The tensile strength is the tension, which is calculated at a tensile test from the maximal reached tensile force in relation to the original cross section of the specimen. As formal sign of the tensile strength is for example used the expression $R_m$. Dimension of the tensile force is force per area. Often used measurement units are $N/mm^2$ or MPa. The tensile strength is often used for the characterization of materials.

The uniform elongation $A_g$ is at the tensile test the plastic length change $L_{pm}$-$L_0$ in relation to the initial length $L_0$ at loading the tensile specimen with the maximal force $F_m$. This is mostly reached at the tensile strength $R_m$. The uniform elongation $A_g$ indicates that the tensile specimen does not reveal necking until the maximum force, but stretches uniformly.

$$A_g = \frac{L_{pm} - L_0}{L_0} \cdot 100\% = \left(\frac{L_{pm}}{L_0} - 1\right) \cdot 100\%$$

The yield strength $R_e$ is a material parameter and designates that tension, to which a material has no permanent plastic deformation at uniaxial and moment free tensile load. This refers to a yield point. At exceeding the yield strength, the material does not return anymore back to the original shape, but a specimen prolongation remains. The yield strength is commonly determined though tensile test.

Increasing importance gain components/constituents made of steel materials in a tensile strength range between 600 MPa and 1200 MPa. The steel-banana (s. FIG. 1) is characterized in that the product of tensile strength and elongation at break is roughly equal for many steel grades and lies for common low cost steels with ferritic, pearlitic, bainitic or martensitic matrix at about 15000 MPa*%. The product of tensile strength ($R_m$) measured in a quasi static tensile test in MPa and elongation at break (A) in % can taken as simple quality criterion for a steel, wherein attention need to be paid in detail on the different criteria for measuring the elongation at break. Usually, the total elongation at break A5 consisting of a portion of uniform elongation and a portion of necking elongation forms the basis for this comparative illustration.

An increase of the ductility at constant strength enables one the one side a higher energy absorption at overload (component safety), and on the other side there is the potential for further cold working steps such that more complex components can be manufactured.

A design target for the manufacturing of new, high strength steels is therefore often the increase of this product of $R_m$*A. Results of such efforts is for example TRIP steels and TWIP steels with a product of $R_m$*A of sometimes more than 50000 MPa*%. For different reasons, e.g. costs and difficulties during processing, the practical use of such steel grades is presently limited though.

In FIG. 1, MILD means commonly deep drawing grades, BH "bake hardening steel", i.e. higher strength steels with yield strength increase by means of the paint baking, IF "interstitial free steel", i.e. steel without interstitial dissolved alloy contents, HSLA "high strength low alloy steel", i.e. high strength low alloyed steel, TRIP "transformation induced plasticity steel", i.e. steel with though crystal lattice transformation induced plastic deformation, TWIP "Twinning induced plasticity steels" DP-CP dual phases/complex phases with soft ferrite, MS martensitic phase steel, IS isotropic steel, IF-HS higher strength IF steel, CMn manganese-carbon-steel (common structural steel).

Semi-finished good is the general term for pre-manufactured raw material shapes like for example sheets, rods, pipes and coils. In the manufacturing technology, semi-finished goods represent by far the most spread delivery form for metal materials. It is distinguished between over 1000 sorts of semi-finished goods made of metal and plastic, which each are standardized in terms of material and surface quality, shape and dimensions as well as their tolerances. Typically for semi-finished goods is that the first processing step consists of a cutting, wherein the needed material section is cut off by means of a suitable method (e.g. sawing). This material section is further processed to the actual finished part.

High geometrical precision of semi-finished goods and finished products are reached through a cold working, e.g. cold rolling of strip material, cold drawing of pipes, cold heading of rod material, thread rollers, etc. By means of the cold working, also the strength of the semi finished goods and products highly increases. A significant cold working generally results in that the product of tensile strength and elongation reduces dramatically due to the drastically reduction of the ductility.

A cold worked steel with a strength of 1000 MPa and a resulting elongation of 2% has for example only a product $R_m$*A of 2000 MPa %.

Nevertheless, the use of cold working of cost efficient low alloyed steel grades has a high importance to an economic light weight construction in different applications.

Along with the strength increase is however related disadvantageously also a considerable reduction of ductility such that a further plastic deformation in following processes is not directly possible. Furthermore, in many cases plastic deformability is also requested for the component safety in order to enable depending on the application a more or less high energy absorption before a break.

For adjustment of an improved ductility after the cold working, the steel commonly undergoes a heat treatment. During annealing under a shielding gas (e.g. nitrogen, argon) in an area between 600 and 700° C. above the recrystallization temperature recrystallizes the material, the cold work hardening is mostly removed and a high plastic deformability is obtained. This process is usually called normalizing.

Also industrial practice is a stress relief annealing below the recrystallization temperature. During annealing below the recrystallization temperature, a so-called crystal regeneration occurs with steels. Crystal regeneration leads to reduction of stress. Grain shape and grain size of the deformed microstructure are preserved. The reduction of inner stress is connected with a moderate increase of the ductility and a moderate reduction of strength. The process window of such a stress relief annealing is comparatively narrow, because the temperature usually has to be brought close to the recrystallization in order to reach a considerable increase of the ductility. This temperature is furthermore not only material dependent, but also dependent from the pre-deformation. Thanks to the stress relief annealing the ductility can in fact be increased, but the product of $R_m$*A commonly only reach values below 10000 MPa %. If high values of $R_m$*A at high strength should be reached, there is moreover an extensive risk due to the narrow process window for fluctuating good (product) properties, which can result in an increased waste.

The heat treatment of cold hardened semi-finished goods is conducted for strip material in flow-through annealing systems and stationary bell type annealing systems. Depending on the furnace loading, only small heating up and cooling down speeds can be reached. The bell type annealing of strip material in form of so-called coils thus require up to several days due to the physical related soak time. A heat treatment of the material, i.e. transformation hardening and tempering, is in general technically not possible having these slow cycles. Furthermore, the transformation hardening is disadvantageous connected with high temperatures and energy use, high costs as well as the risk of distortion of the semi-finished goods.

Therefore, a high strength and at the same time a high deformability at cold worked semi-finished goods and products are only to be reached with difficulties. In particular, at low alloyed, cold worked steels, a strength of more than 750 MPa and a elongation at break A of more than 15% are until now hardly reached in a process safe manner in the chain of cold working and stress relief annealing.#

As a result, there is a technological gap in the strength area 700 MPa to 1200 MPa for bell type annealed cold strip with high ductility. This also applies for pipes and rod materials, which is processed e.g. though cold drawing, cold heading, thread rolling, if heat treatment (transformation hardening and tempering) has to be waived for financial and technological reasons, e.g. occurrence of distortion.

BRIEF DESCRIPTION OF THE DRAWINGS

In FIG. 1, MILD means commonly deep drawing grades, BH "bake hardening steel", i.e. higher strength steels with yield strength increase by means of the paint baking, IF "interstitial free steel", i.e. steel without interstitial dissolved alloy contents. HSLA "high strength low alloy steel", i.e. high strength low alloyed steel, TRIP "transformation induced plasticity steel", i.e. steel with though crystal lattice transformation induced plastic deformation, TWIP "Twinning induced plasticity steels" DP-CP dual phases/complex phases with soft ferrite, MS martensitic phase steel, IS isotropic steel, IF-HS higher strength IF steel, CMn manganese-carbon-steel (common structural steel).

Problem of the Invention

Figure 1:
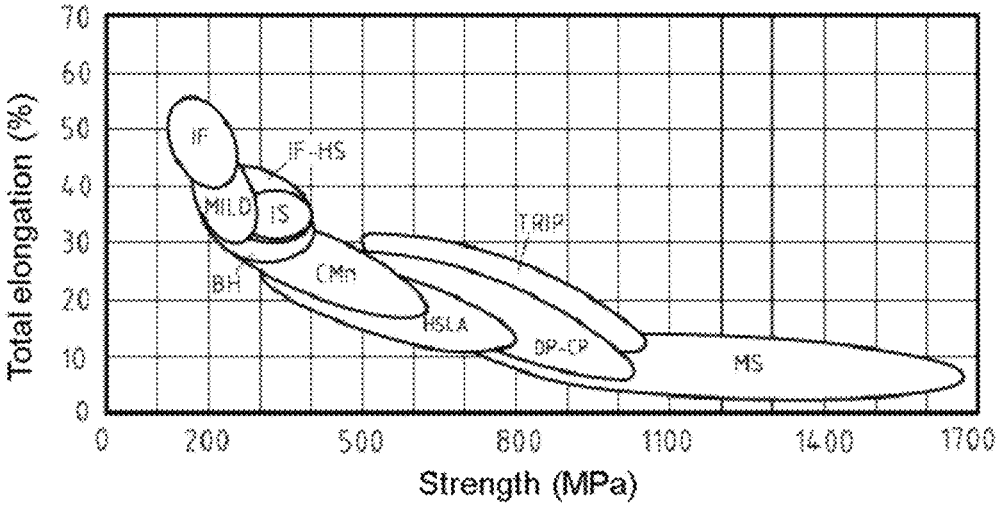
FIG. 1 shows the so-called "steel-banana", which illustrates the relationship of strength and elongation at break for different steel grades.

The problem of the invention based on this background is providing of a technically simple to manufacture component with high strength and ductility as well as to create a manufacturing method.

The problem is solved by a component according to claim 1 as well as by a method with the features of the independent claims. Preferable embodiments are described in the dependent claims.

DISCLOSURE OF THE INVENTION

For solving the problem, it has been proceeded based on a low alloyed steel, which thus comprises a high content of iron. None of the alloying elements of the low alloyed steel exceeds an average content of 5 percent by mass. The content of iron in the steel alloy amounts to particularly more than 90 wt %, preferably more than 96 wt %. The alloy comprises copper as alloying element. Through cold working, a component is formed from the low alloyed steel. The component is in particular a semi-finished good. Subsequent to that, the component is subjected to an annealing treatment below the recrystallization temperature. The thereby applied temperature lies particularly considerably below the recrystallization temperature, which contributes to a technically simple manufacturing. In particular, the temperature lies 100° C. below the recrystallization temperature.

The invention takes advantage of the strength increasing effect though precipitation hardening with copper. From the state of the art, it is not known that cold worked steels of high strength reveal a considerably increase of the ductility in parallel to the strength increase. The invention uses also the precipitation hardening in order to at the same time considerably increase the strength and ductility of the alloy and of the therewith manufactured semi-finished good. The invention enables a safe manufacturing process sequence consisting of cold working and annealing below the recrystallization temperature particularly for the manufacturing of semi-finished goods and components, which preferably show a high ductility in the strength area of 700 to 1200 MPa. Expensive manufacturing steps are avoided. A bell type annealing respectively another annealing method with lower temperature gradient suffice.

Known is the precipitation hardening for many alloy systems, also for steels. The known APF steels (precipitation hardening ferritic-pearlitic steel) thereby reach their high strength though precipitation hardening. Hereby, vanadium carbonitrides are precipitated during cooling of the forge heat. Also higher strength fine grain steels, like e.g. S700MC, obtain their high strength in general though precipitation hardening via carbides, nitrides and carbonitrides of the refractory metals, particularly titanium, niobium, vanadium, molybdenum and tungsten (wolfram).

For more than 50 years, also the precipitation hardening of steel though copper is known (R. C. Glenn, E. Hornbogen, "A metallographic study of precipitation of copper from alpha iron", Trans. Met. Soc. AIME, ed. 218. no 6, p. 1064-1070, 1960). For medium and high alloyed steels, the precipitation hardening with copper is know. At temperatures between 350 and 550° C., fine distributed copper precipitations forms in the steel, which lead to a considerable strength increase (e.g. C. N. Hsiao, C. S. Chiou, J. R. Yang, "Aging reactions in a 17-4 PH stainless steel", Mater. Chem. Phys. ed. 74. no 2, p. 134-142, 2002). The use of copper is also in the USA known for comparatively low alloyed steels, e.g. S. W. Thompson, G. Krauss, "Copper precipitation during continuous cooling and isothermal aging of 710-fype steels", Metall. Mater. Trans. A, ed. 27, no 6, p. 1573-1588, June 1996. However, these are alloyed generally additionally with nickel. Alloy contents of 1-4 wt % copper are common in order to reach a precipitation hardening.

It is further known that further strength increases are reached through at the same time precipitation of the classic carbonitrides, for example TiC and V(C,N).

Copper as alloy element is often considered as vermin in steel, because the unwanted red shortness can occur. Red shortness is caused during the hot working of the steel in a temperature range between 1000 and 1200° C. The red shortness arises from the formation of a copper melt through selective corrosion: At high temperatures of the hot working, the iron at the surface oxidizes/scales, while the more noble copper is enriched. High copper containing boundary zones then get molten. The occurring copper melt reaches the austenite grain boundary in the steel, such that cracks and breaks form at low loads. Red shortness is in practice prevented though additionally alloying with nickel, which causes a change of the oxidation and thereby prevent the occurrence of selective corrosion. The established additional alloying with nickel is however disadvantageous due to the thereby related very high alloy costs. Nickel contents in the order of the common copper contents are e.g. generally in the automotive industry not accepted. Preferably, the low alloyed steel, which forms the basis herein, contains no nickel or only a very low portion of nickel. The solution approach pursued according to the invention is thus the use of precipitation hardening though the alloying with copper, wherein the common alloying with nickel shall be waived entirely or at least mostly for financial reasons.

In the production chain of semi-finished goods made of steel, the working at the critical temperatures of the red shortness is the industrial practice. The usability of a new steel alloy in the industrial production therefore requires measures in order to suppress the effect of red shortness. Red shortness is supported though too long hold times during the heating in not suitable furnace atmospheres.

It is known that the phenomena of red shortness can be also prevented though the smart procedure in the production chain. For example, the oxygen partial pressure can be reduced though suitable furnace atmospheres during heating in the furnace such that no selective corrosion occurs.

However, it is desirable for the practical feasibility when the alloy according to the invention reveals a low susceptibility to red shortness.

Hot tensile tests on specimens made of different test melts could show that though a cost efficient alloying with boron the hot ductility could be considerably increased advantageously according to the invention. At a test temperature of 1000° C., the necking Z (reduction in area at break or failure) as a measure for the ductility could be increased from 25% to 94% during hot tensile test.

In further characterizations of the test alloys it shows at first the in literature described and expected effect of a strength increase by ca. 200 MPa per percent copper addition.

At a precipitation hardening after differently strong cold workings, it was furthermore observed a surprising, considerable increase of the ductility far below the usual recrystallization temperatures. At low annealing temperatures of preferably below 420° C., a considerable increase of the elongation at break at flat specimen of the measuring length 50 mm A50>15% could be determined at the same time with a strength increase for the test alloys according to the invention. In A50 the number 50 represents here the measuring length. The strength increase is herein dependent from the cold working: low cold worked specimen (15%) show a higher strength increase (15%) than high cold worked specimen (>60%) with a only low increase of 2%. Thereby, differently strong cold workings are partly compensated though the precipitation hardening with copper.

Moreover, the alloys according to the invention are characterized by a high cold workability of more than 80%. The strength and ductility can herein be varied on a high level above a yield strength of 750 MPa though variation of degree of deformation and heat treatment temperature. Herewith, high products of strength $R_m$ and elongation at break A50 of more than 15000 MPa-% are reached. Already at annealing temperatures below 420° C. uniform elongations $A_g$ of more than 10% are reached.

The alloy according to the invention comprises mandatorily iron and copper and furthermore one or more of the moreover following mentioned constituents. In the following, all percent data concern wt % of the total alloy, if not differently indicated.

Iron: main constituent of the alloy is iron with a content of preferably at least 96 wt %. A high iron content secures low costs in relation to the composition of the alloy and during the processing over the entire production chain. Higher alloy contents respectively lower iron contents in the conventional steel works, in which ordinary steels are cost efficiently produced, lead to long times for the alloy treatment in the ladle such that a low cost production process is hampered. Copper: 0.5-2.0 wg. %, preferably 0.8 to 1.6 wg. %, particularly preferred 1.0 to 1.5 wg. % copper improves the cold workability at high basic strengths. Copper is dissolved in the ferrite mixed crystal and leads to a mixed crystal hardening (solidification) of ca. 40 MPa per % dissolved copper. During heat treatment in the temperature area of 250° C. to 600° C., the copper leaves the alpha mixed crystal and forms fine precipitations. The precipitations provide a considerable higher contribution of ca. 200 MPa per % precipitated copper to the strength than the preceding mixed crystal hardening (solidification). The crystal lattice of the alpha mixed crystals being tensed up though an earlier cold working is relaxed by diffusion of the Cu atoms out of it such that the ductility far below the recrystallization temperature increases considerably. Below 0.4 wt % copper, the effect of the copper is comparatively low. Above of 1.6 wg %, the use is limited for financial reasons.

Carbon can be present in low contents, preferably 0.04-0.12 wg %, particularly preferred 0.04 to 0.08 wg %: A low carbon content secures a very good deformability and a very good weldability. In particular, the cold working is thus facilitated by the carbon content.

Cr—Si—Mn—Ni: Though a variation of the contents of Cr, Si, Mn and Ni, the basic strength of the steel and the hardening (solidification) behaviors are influenced. The sum of Cr+Mn+Si+Ni lies according to the invention preferably in the area of 0.5 to 2.5 wt %. In particular, the contents of silicon and manganese are as following, wherein the total amount of Cr+Mn+Si+Ni is defined as above:

Silicon: 0-2 wt %. preferred 0.8-1.2 wt %. A corresponding Si content has a beneficial influence on the ductility and hardening (solidification) during the cold working and improves the scale resistance and has therefore also a positive influence on the reduction of the risk of red shortness.

Manganese: 0.3-2 wg %. preferred 0.3-0.6 wt %. A comparatively low Mn content influences the segregation behavior during continuous casting in a positive way and improvs the deformability. A higher manganese content of 0.6 to 2% leads to a higher basic strength.

Nitrogen: preferably 0 to 0.01 wt %, particularly preferred 0.003-0.008 wg %. Nitrogen is commonly a usual accompanying element.

Boron: preferably 0 to 0.01 wt %, particularly preferred 0.001-0.005 wt %. Boron is as dissolved element in austenite interfacial active. It improves at common low alloyed alloys the hardenability though delay of the ferrite grain formation at the austenite grain boundaries. Here, the boron addition reduces the risk of red shortness.

Aluminum: preferably 0 to 0.04 wt %. Aluminum is a common alloying element for deoxidation, which is added particularly at low manganese and silicon contents.

Ti—Nb—V—Mo—W: These refractory metals form carbides and nitrides, which as fine precipitations can increase the strength. A strength increase at the same time though precipitation of refractory carbon nitrides is possible in addition to the hardening with Cu. The sum of the mentioned elements should lie at first below 0.3 wt % solely for financial reasons. Moreover, the effectiveness of the refractory metals is tied to available carbon and/or nitrogen.

Titanium: preferably 0 to 0.1 wt %, particularly preferred 0.02-0.05 wt %. Titanium sets the here unwanted nitrogen in a relation of 3.2.nitrogen content in wt % at high temperatures >1000° C. and prevents the formation of here unwanted boron nitrides. Above this contents Ti is available for a precipitation hardening together with C at low temperatures in an area 300-600° C. Titanium carbides can contribute to a further precipitation hardening in parallel to the copper precipitations. Disadvantageously connected with higher Ti contents is the setting of the dissolved boron in form of titanium borides, which forms already at high temperatures.

The alloy according to the invention can comprise small amounts of further elements like for example in form of the common accompanying elements as impurities. These impurities are mostly unavoidable admixtures like e.g. sulfur and phosphorous, tin, antimony. The amount of impurities is dependent from the production procedures in the steelworks and should lie in sum usually below 0.03 wt %.

Particularly preferred, the alloy consists of (in wt % in relation to the total alloy, wherein the sum of all constituents equals 100 wt %)

| | |
|---|---|
| iron | ≥96 |
| carbon | 0.04 to 0.12 |
| copper | 0.5 to 2.0 |
| manganese + silicon + chromium + nickel | 0.5 to 2.5 |
| titanium | 0 to 0.1 |
| boron | 0 to 0.005 |

as well as commonly unavoidable impurities. During the manufacturing of semi-finished goods and components made of this alloy, a combination of cold working and annealing treatment below the recrystallization temperature is applied.

The component according to the invention is preferably a component in form of a sheet, pipe or rod, because at these semi finished goods a high precision and/or low wall thickness is required for an efficient light weight construction. The use of cold worked materials is adventurously linked with narrow tolerances and good, scale free surfaces.

Other components can be manufactured from these semi-finished goods. According to the invention, other components can be manufactured from the semi-finished goods flat material, wire, pipe and combinations thereof. The required cold working is carried out either already during the manufacturing of the semi-fished goods, e.g. cold strip, cold workable, e.g. drawn pipe and/or wire made of the alloy, or only at the final deformation of soft semi-finished good. The technology is particularly advantageous suitable for components with variable wall thicknesses, e.g. so-called TRB (Tailor Rolled Blank", as strength differences due to different deformation degrees can be compensated partially. The wall thickness, sheet thickness or cross section of the component can vary within the component e.g. by up to 60% in relation to the initial thickness respectively initial strength (thickness), thus for example be reduced. Preferably, it is varied respectively reduced by at least 30%.

In all, the cold working in form of a cross section reduction of at least 10% up to 90% is possible in relation to the initial cross section.

Preferably, the cold working of semi-finished goods made of the alloy according to the invention is carried out though common cold working methods. Exemplarily mentioned are for example cold drawing, cold rolling of strips and/or profiling, calibration rolling, cold heading, thread rolling, deep drawing, cupping, press rolling, round kneading. The cold working is carried out according to the invention preferably at temperatures below 400° C., particularly preferred at room temperature. The dimensional change reached though the cold working amounts to preferably at least 10% in relation to the initial dimension.

The subsequent annealing treatment for the increase of the ductility and strength is carried out according to the invention at temperatures of preferably between 300 and 600° C., preferably 250 to 500° C. at an overall duration of 30 minutes to 48 h such that neither an unwanted distortion nor a scaling of the surface occurs. The duration of the annealing treatment is in wide areas variable, because for example big masses in form of coils with several tons of weight have a high thermal inertia. For such masses results a shortening of the process time by several hours due to the reduced maximal temperature compared to the common stress relief annealing. The effectiveness of the method was verified for process durations of 1 h for thin walled components and 36 h for big coils.

The excellent surface quality of the components according to the invention also secures good fatigue properties at cyclic loading.

Furthermore, along with the low annealing temperatures, a considerable reduced energy consumption is needed compared to recrystallization annealing or heat treatment required by the state of the art, which requires a heating to 600° C. to 950° C.

Common alloys, like fine grain grades S355, S420MC, show during stress relief annealing after the cold working a considerable reduction in strength and a only moderate increase of the ductility. The product of strength $R_m$ and elongation A50 lies after annealing below the recrystallization temperature commonly below 10000 MPa-%. Uniform elongations of more than 10% are reached only above the recrystallization temperature of e.g. 600° C. Therefore, in the industrial practice, components with corresponding requirements in terms of strength are until now mostly heat treated by hardening and tempering with disadvantages concerning energy use, surface quality and precision due to distortion.

The alloy according to the invention is produced in the usual way, e.g. via the blast furnace route, direct reduction steelworks and electronic steelworks. The alloy composition is produced by the common ladle metallurgy, wherein the chemical composition is verified by means of suitable methods, e.g. optical emission spectroscopy (OES).

The cast for the here relevant mass production is usually carried out by continuous casting.

The rolling out of strip and rod material is carried out e.g. in common hot rolling lines, e.g. hot broad strip lines. The creation in integrated casting rolling systems is particularly advantageous, because cost advantages are created here thanks to a beneficial energy balance.

Moreover, the direct use of the steel from the cast heat without separate intermediate heating has lower risks related to a potential risk of red shortness.

Subsequent to that, the alloy is treated further according to the invention by cold working and the above mentioned annealing treatment in order to achieve the desired high ductility and high strength.

The components resp. semi-finished goods according to the invention preferably reveal a product of tensile strength and elongation at break of at least 12000 MPa*% as well as a tensile strength $R_m$ of at least 600 MPa.

The semi-finished good resp. component according to the invention has preferably a tensile strength of at least 900 MPa and more preferred of at least 1000 MPa, a yield strength $R_p0.2$ of at least 800 MPa, preferably at least 900 MPa and an elongation at break of at least 10%.

Elongation at break A, tensile strength $R_m$ and yield strength $R_p0.2$ are according to the invention determined e.g. by help of standardized quasi-static tensile tests.

The invention is in the following further explained by means of application examples.

Components according to the invention are particularly obtained by a degree of cold working of more than 15% (in relation to the initial cross section), wherein subsequently at low temperatures between 350 and 500° C. it was at the same time conducted stress relief annealing and precipitation hardening.

By means of the invention, an improved energy efficacy in the process chain from steel to product is achieved, because annealing temperatures can be considerably reduced. A comparatively high fluctuation range of properties can be observed with multi phase steels (DP, CP, TRIP). The high fluctuation range of properties at multi phase steels results in that during the lay out design of products the worst case is assumed each time, i.e. it is designed with comparatively bad properties. The present invention allows achieving considerable more uniform properties, because they need not to be adjusted over complex time temperature guidances. In this way, disadvantages are also avoided by means of the present invention.

Application 1:

A possible application is the resource efficient production of cost efficient steel pipes. The necessary cold working is carried out by one or more cold drawing devices and/or calibration rollers. Seamless pipes are preferably processed by cold drawing, while welded pipes are often profiled in one working step. The pipes are herewith frequently at the same time not only rolled to measure, but also special profiles in cross section are manufactured such that complex hollow profiles can be generated.

Until now it is common to bring the ductility of cold workable pipes and hollow profiles to a tolerable measure by means of stress relief annealing below the recrystallization temperature (BKS annealing). However, only a low ductility at limited strength is thereby generally reached, e.g. 700 MPa strength at below 10% elongation at break, if for example a S460 is cold hardened and stress relief annealed.

The material and method combination according to the invention allows a strength of more than 900 MPa at a elongation at break of more than 15%, wherein also lower strengths at then considerably higher elongations at break are possible. The material and method combination according to the invention also allows at the same time an increase of strength and ductility as well as a reduction of the annealing temperature of until now generally more than 600° C. to considerably below 500° C., so that energy can be saved. Moreover, the deformation capability is considerably better so that higher deformation degrees during drawing and/or calibration is enabled as if e.g. common fine grain steels in an area S355 to S500MC were utilized.

Application 2:

A possible application of the alloy according to the invention is the cold heading based on wire and rod material. This is the common method for manufacturing of screws, fastening elements, ball pins, etc., to which high requirements on strength and ductility are imposed. Having very high requirements on the strength, complex processes are frequently used until now in order to form conventional steel grades, like 42CrMo4 or 41Cr4 via drawing and cold workings with intermediate annealings to a geometrical suitable component. After that, a heat treatment in form of hardening and tempering is then necessary with following processings, because the component surface has to be post-processed after the usual heat treatment.

It is known that bainitic cold heading grades were used in the last years, which allow the adjustment of a high strength also without heat treatment, e.g. 8MnCrB3 or 8MnSi7. Strengths of 800 MPa and slightly there above are possible without heat treatment. These materials obtain their strength from the bainitic base microstructure and a cold hardening. Compared with the material and method combination according to the invention, there is a lower workability.

The material and method combination according to the invention enables through excellent cold workability the entire cold shaping also of more complex geometries without intermediate annealing. Thereby, higher deformations than during use of the mentioned cold heading grades are possible. A cold hardening to a yield strength of more than 1000 MPa is possible. The subsequent annealing process according to the invention in a temperature area of 300 to 500° C. enables an increase of the elongation at break to over 12%.

Application 3:

The manufacturing of thin sheets made of steel—usually below about 2 mm to below 0.1 mm—is carried out as cold strip. Cold strip can also be manufactured in different, graded thicknesses as so-called TRB material. The different thicknesses enable an improved light weight construction though targeted material use. Light weight construction with steel requires possibly high strength at good ductility. In analogy to application 1 and 2, the use of the material and method combination enables a considerable increase of ductility and strength compared with the state of the art.

Application 4:

The processing of sheets (and profiles) requires a high deformability at complex geometries. The material and method combination according to the invention can be used also during the processing of sheets (and profiles) e.g. though deep drawing, cupping and similar methods. The semi-finished good is used hereby in a normalized/recrystallized condition. The very good deformability enables the manufacturing of complex geometries, e.g. via drawing technical or bending technical methods. Subsequent to that, an annealing treatment is carried out, which lies with 300-400° C. indeed above the otherwise common Bake hardening temperature, but allows a comparatively high strength increase. While a strength increase between 40-90 MPa is possible via bake hardening, the strength can be increased according to the invention by more than 200 MPa. Therewith, complex shaped components with a strength of more than 600 MPa can be manufactured while common bake hardening steels are limited to below 400 MPa during application.

A component that was manufactured in the claimed manner differs in terms of its structure resp. microstructure compared to the state of the art and can thus be identified as illustrated in the following.

Figure 2:
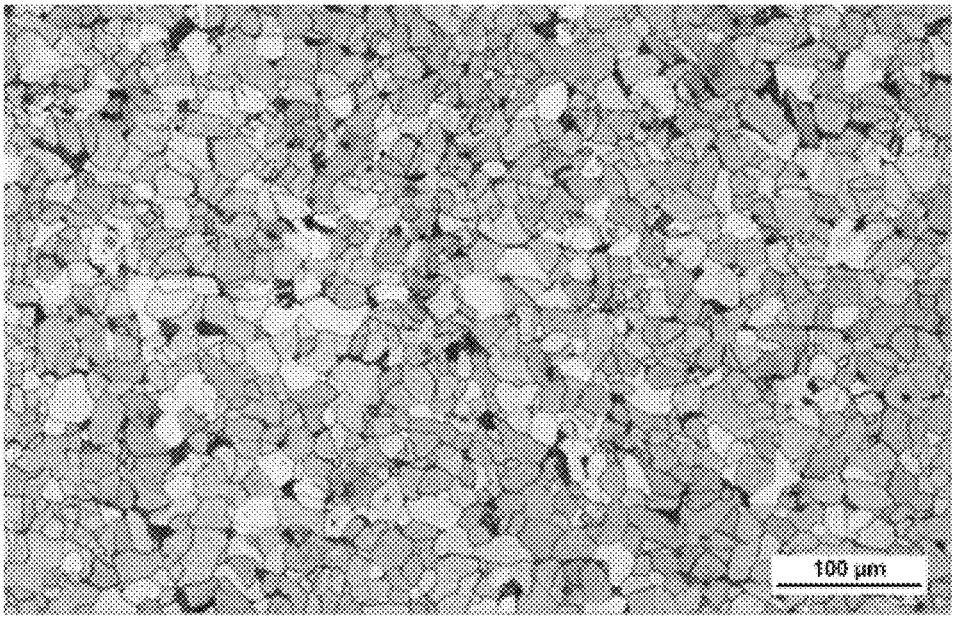
FIG. 2 shows a microstructure of a low alloyed, ferritic steel with low portion of pearlite in normalized condition.

The FIG. 2 shows a microstructure of a low alloyed, ferritic steel with low portion of pearlite in normalized condition. The pearlite is recognizable as black microstructural constituent. The microstructure corresponds to CMn steel in FIG. 1. At steels with low carbon content, small pearlite islands are embedded in a ferritic matrix in normalized condition. Also HSLA steels show a similar microstructure that however reveals considerably smaller grains due to a micro alloy and a special thermomechanical treatment.

Figure 3:
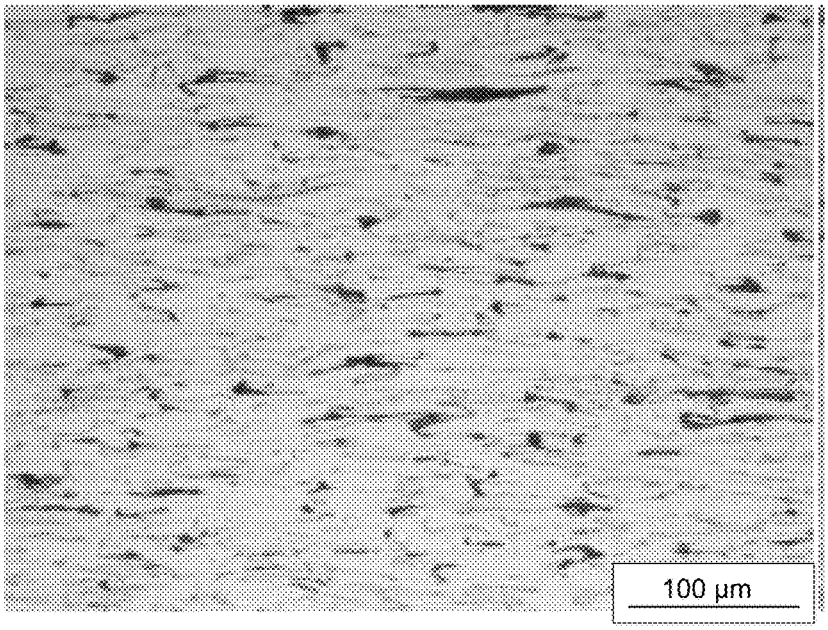
FIG. 3 shows the microstructure of a cold rolled steel corresponding FIG. 2 after a high cold deformation (thickness reduction from 8 mm to 2 mm without intermediate heating).

The FIG. 3 illustrates how the microstructure of FIG. 2 changes though cold working. Shown is the microstructure of a cold rolled steel corresponding FIG. 2 after a high cold deformation (thickness reduction from 8 mm to 2 mm without intermediate heating). Clearly recognizable are stretched grains due to the cold deformation corresponding to the direction of deformation. The ductility of such microstructures is however low so that at high strengths there is an elongation at break A5 of commonly below 10%. A semi-finished good and/or component according to the invention shows a corresponding microstructure according to FIG. 3, because it was only stress relief annealed considerably below the recrystallization temperature. A low stress annealed microstructure (stress relief annealing (DIN EN 10052:1993)) is characterized in that there occurs no substantial change of the microstructure: heat treatment consists of heating and holding at sufficient high temperature and subsequent cooling in order to remove as far as possible inner tensions without substantial change of the microstructure. Along with the removal of the inner stress, the ductility increases comparatively slightly. Commonly, temperatures between 550 and 650° C. are needed for this purpose. According to the invention, in contrast, preferably temperatures between 350° C. and 500° C. are used in order to precipitate Cu particles. Components according to the invention are accordingly characterized by Cu particles with the size between 1 and 20 nanometer as often described in the scientific literature.

Figure 4:
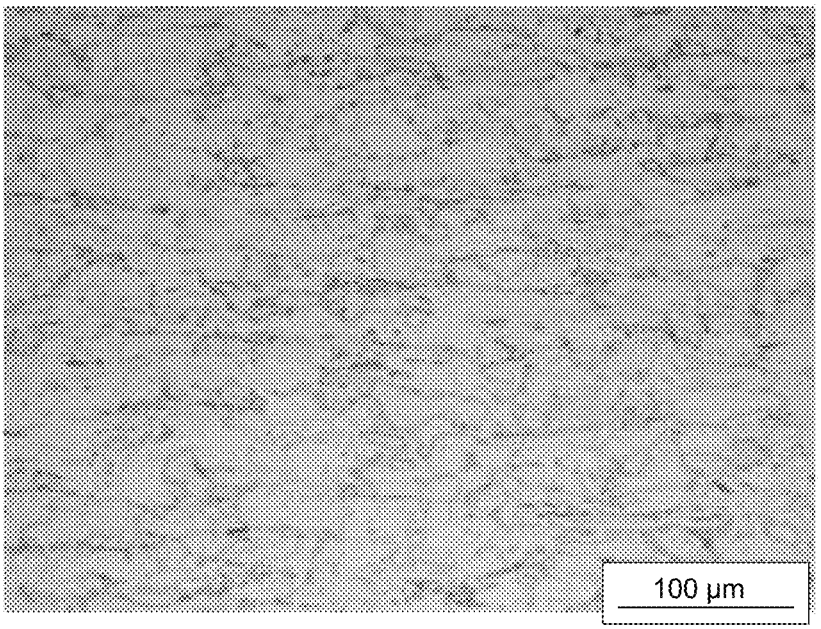
FIG. 4 shows the microstructure of the cold rolled steel of FIG. 3 after an annealing above the recrystallization temperature.

FIG. 4 shows the microstructure of the cold rolled steel of FIG. 3 after an annealing above the recrystallization temperature. New globular grains as well as a more fine characteristic of the cementite are clearly recognizable. Usually, the recrystallization microstructure is more fine than the microstructure of the FIGS. 2 and 3.

As the FIGS. 2 and 3 illustrate, it can be determined though a microstructure analysis, if a component was obtained though cold working or not. As the FIGS. 3 and 4 illustrate, a microstructure analysis enables to determine if a component was annealed above the recrystallization temperature or not. In the conventional light microscopy, point and linear section methods are used to determine the recrystallized microstructure portion. In case of doubt, also for example a EBSD analysis (Electron Beam Backscatter Diffraction) can show if there is a recrystallization. For distinguishing of the recrystallized and not recrystallized condition, the scattering of the misorientation angle in a grain can be used for this purpose. In case that there are recrystallized and not recrystallized portions, these can be visualized for example though the distribution misorientation scattering. If this scattering is small, then there is a recrystallized grain.

Figure 5:
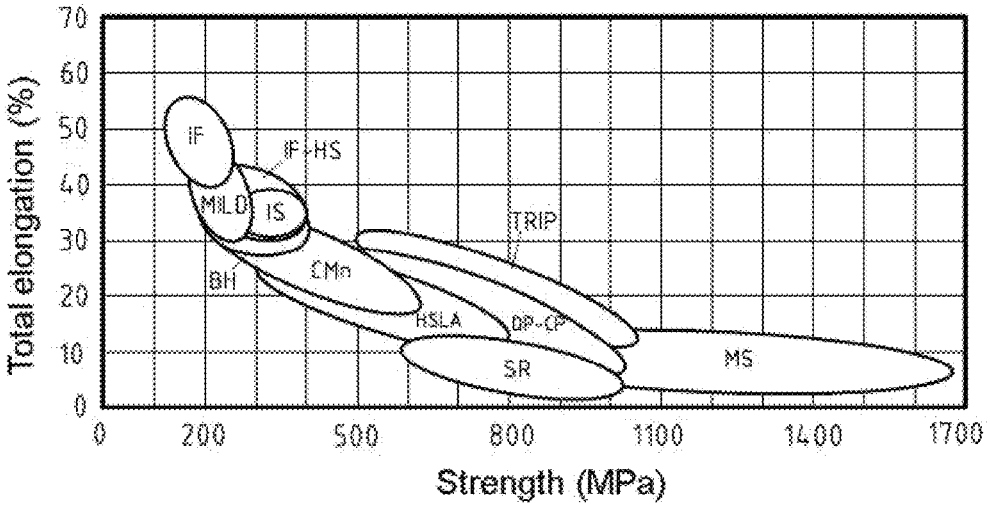
FIG. 5 shows that by means of cold working with subsequent stress relief annealing, high strength steels can be created, which were inserted compared to FIG. 1 as SR (stress relief annealed).

By means of cold working with subsequent stress relief annealing, high strength steels can be created, which were inserted compared to FIG. 1 as SR (stress relief annealed) in FIG. 5. It is recognizable that indeed similar strengths like with modern HSLA, DP, CP, TRIP steels are reached, but having a considerable lower ductility. This lower ductility is not sufficient for many applications.

Figure 6:
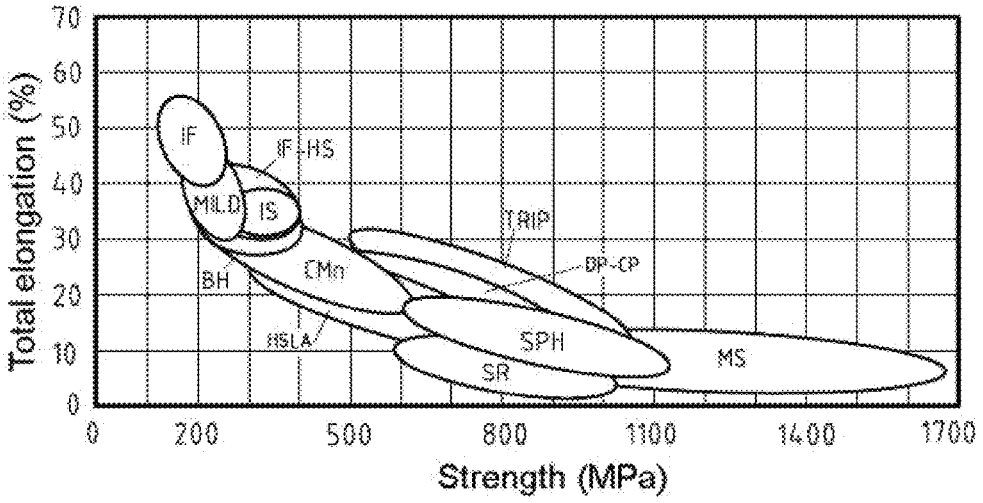
FIG. 6 shows steels including semi-finished goods and components compared to the FIGS. 1 and 5 inserted as SPH (stress relief annealed, precipitation hardened).

Steels according to the invention incl. Semi-finished goods and components were compared to the FIGS. 1 and 5 inserted as SPH (stress relief annealed, precipitation hardened) in FIG. 6. In contrast to the conventional, cold worked and stress relief annealed SR grades, there is a higher strength and higher ductility. Concerning strength and ductility, a wide area is feasible by alloy variation, variation of the cold working and variation of the annealing treatment. The product of strength $R_m$ and elongation usually lies higher than at SR steels and can reach the common level of HSLA, DP, CP steels.

The identification of ductility and/or the analysis of the Cu particles enable to determine if an annealing treatment was conducted or not in a claimed manner.

In all, it can therefore be determined at a component, if it was produced though cold working and subsequent annealing considerably below the recrystallization temperature and thus fall into the claimed area or not.

Figure 7:
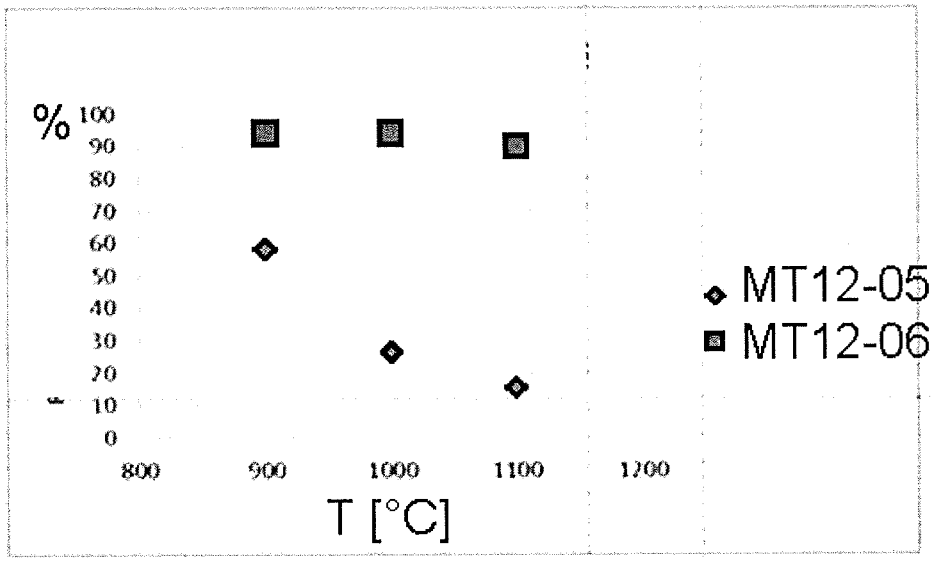
FIG. 7 shows the positive effect of boron and also titanium on the high temperature ductility of Cu alloyed steels.

The FIG. 7 illustrated the positive effect of boron and also titanium on the high temperature ductility of Cu alloyed steels. Compared is a low alloyed steel called MT12-05 with a low alloyed steel, which is called MT12-06 in the FIG. 7. Both steels comprised 0.06 wt % C, 1 wt % Si, 0.8 wt % Mn and 1 wt % Cu. The steel MT12-06 comprised in addition 0.03 wt % Ti as well as 0.003 wt % B. Plotted is the deformability in % until failure of the material over the temperature. The FIG. 7 shows that the steel MT12-06 allows considerable more deformation than the steel MT12-05. The high temperature ductility of Cu alloyed steels can therefore be considerably improved by B as well as Ti and thus reduce the risk of red shortness.

The invention claimed is:

1. Component made of a low alloyed steel comprising iron, copper, titanium, and boron, and optionally nitrogen, wherein the component is obtained by cold working of the steel alloy and a subsequent annealing treatment at a temperature below the recrystallization temperature of the steel alloy, wherein the low alloyed steel comprises:

iron at >96 wt %;

carbon at 0.04 to 0.12 wt %;

copper at 0.5 to 2.0 wt %;

manganese+silicon+chromium+nickel at 0.5 to 2.5 wt %;

titanium at more than 0 to not more than 0.1 wt %; and boron at more than 0 to not more than 0.005 wt %, wherein the wt % is in relation to the entire alloy, and wherein the sum of all of the above elements equals 100 wt %.

2. Component according to claim 1, wherein the annealing treatment is carried out at a temperature at least 100° C. below the recrystallization temperature of the steel alloy and/or wherein the temperature is not more than 420° C. and/or wherein the temperature is at least 300° C.

3. Component according to claim 1 comprising a microstructure, wherein the microstructure contains more than 80% not recrystallized grains after the cold working.

4. Component according to claim 1, wherein the component comprises copper particles with an average particle size between about 1 and about 50 nanometers.

5. Component according to claim 1, wherein the copper is present in the low alloyed steel between about 1.0 to about 1.5 wt %.

6. Component according to claim 1, wherein the low alloyed steel consists of iron at >96 wt %;

carbon at 0.04 to 0.12 wt %;

copper at 0.5 to 2.0 wt %;

manganese+silicon+chromium+nickel at 0.5 to 2.5 wt %;

titanium at 0 to 0.1 wt %; and boron at 0 to 0.005 wt %; and wherein the wt % is in relation to the entire alloy, and wherein the sum of all of the above elements equals 100 wt %.

7. Component according to claim 1, wherein silicon is present in the low alloyed steel between about 0% to about 2 wt %.

8. Component according to claim 1, wherein manganese is present in the low alloyed steel between about 0.3%-about 2 wt %.

9. Component according to claim 1, wherein chromium is present in the low alloyed steel between about 0% to about 0.8 wt %.

10. Component according to claim 1, wherein boron is present between about 0.001% to about 0.005%.

11. Component according to claim 1, wherein titanium in the low alloyed steel is present between about 0.02% to about 0.05 wt %, and wherein titanium is present at about 3.2 times of the amount of nitrogen (in wt %).

12. Component according to claim 1, wherein carbon in the low alloyed steel is present between about 0.04% to about 0.08 wt %.

13. Component according to claim 1, wherein the component or semi-finished good have a product of tensile strength $R_m$ and elongation at break A of more than 12000 MPa*% and its tensile strength $R_m$ is greater than 600 MPa.

14. Component according to claim 1, wherein the tensile strength $R_m$ is at least 900 MPa, the yield strength Rp0.2 is at least 800 MPa, and wherein the component has a product of tensile strength $R_m$ and elongation at break A of more than 12000 MPa*%.

15. Component according to claim 1, wherein the component has a wall thickness difference or a sheet thickness difference or a cross section difference of more than 10% within the component in relation to the maximal value.

* * * * *